United States Patent [19]

Schmeling et al.

[11] Patent Number: 4,978,432

[45] Date of Patent: Dec. 18, 1990

[54] METHOD OF PRODUCING PROTECTIVE COATINGS THAT ARE RESISTANT TO CORROSION AND WEAR ON MAGNESIUM AND MAGNESIUM ALLOYS

[75] Inventors: Edith L. Schmeling, Brühl-Badorf; Benno Röschenbleck, Osnabrück; Michael H. Weidemann, Kerpen-Horrem, all of Fed. Rep. of Germany

[73] Assignee: Electro Chemical Engineering GMBH, Aug, Switzerland

[21] Appl. No.: 321,431

[22] Filed: Mar. 9, 1989

[30] Foreign Application Priority Data

Mar. 15, 1988 [DE] Fed. Rep. of Germany ..... 3808609

[51] Int. Cl.[5] ..... C25D 11/30

[52] U.S. Cl. ..... 204/58.4

[58] Field of Search ..... 204/58.4

[56] References Cited

U.S. PATENT DOCUMENTS 2,880,148 3/1959 Evangelides ..... 204/58.4

*Primary Examiner*—T. M. Tufariello

*Attorney, Agent, or Firm*—Sprung, Horn Kramer & Woods

[57] ABSTRACT

A method of producing protective coatings that are resistant to corrosion and wear on magnesium and magnesium alloys by anodic oxidation. In order to obtain coatings that have little or no inherent color, that can be easily colored, and that provide a satisfactory adhesive base for lacquering or subsequent processing, a low-alkali aqueous electrolyte bath containing (a) borate or sulfonate anions and (b) phosphate and fluoride or chloride ions and adjusted to a pH of 5 to 11 and preferably 8 to 9 is employed. A direct current is applied and is either briefly turned off or its polarity incompletely reversed to allow the formation of manganese phosphate and magnesium fluoride or magnesium chloride and optionally magnesium aluminate.

19 Claims, No Drawings

METHOD OF PRODUCING PROTECTIVE COATINGS THAT ARE RESISTANT TO CORROSION AND WEAR ON MAGNESIUM AND MAGNESIUM ALLOYS

Magnesium is becoming increasingly significant as a light-weight metal structural material (with a density of 1.74 g/cm$^3$) in many industries-- aircraft construction, space technology, optics, and automobile manufacturing, for example. Magnesium, however, has the drawback as a structural material that it does not resist corrosion very well without preliminary surface treatment. Many methods of increasing the resistance to corrosion and wear of magnesium arc known. These methods include such chemical and electrochemical processes as chromating and anodic oxidation.

In anodic oxidation, the degreased magnesium parts are immersed as anodes in an electrolyte bath. When current flows through the bath, the negatively charged ions migrate to the anode, where they become discharged. This process is accompanied by the occurrence of atomic oxygen, which leads to the formation of magnesium oxide. The resulting anodic coating is securely anchored to the surface of the magnesium.

The known electrochemical methods of coating magnesium by anodic oxidation employ either powerful oxidants or peroxides or substances that are converted into peroxy compounds during anodic polarization (e.g. Canadian Patent No. 568,653). It can be assumed that the oxygen responsible for the oxidation results from the breakdown of the peroxy compounds, which then proceed to reconstitute themselves at high current densities in the pores of insulating coating on the magnesium. When such powerful oxidants as chromates, vanadates, and permanganates are employed, the atomic oxygen derives from the reduction of whatever element is present in the oxidant at its highest oxidation stage, followed by reoxidation.

The oxidants or peroxy compounds employed in the known methods of anodically oxidizing magnesium or magnesium alloys contain such transition metals as chromium, vanadium or manganese. This situation has turned out to be a drawback in that some of the transition-metal compounds become established in the protective coating on the surface of the magnesium, as becomes evident from its color. The insertion of these compounds lowers the resistance of the protective coating to corrosion and wear.

One object of the present invention is accordingly to provide a method of producing a protective coating on magnesium and magnesium alloys by anodic oxidation, wherein the coating will be highly resistant to corrosion and wear.

Another object of the present invention is to produce coatings with very little or no inherent coloration, that can be satisfactorily colored, and that present a satisfactory adhesive base for lacquering or other processing.

These objects are realzied by a method of anodic oxidation that employs a low-alkali aqueous bath containing (a) borate or sulfate anions and (b) phosphate and fluoride or chloride ions and adjusted to a pH of 5 to 11 and preferably 8 to 9.

Direct current is employed and is either briefly turned off or its polarity incompletely reversed to allow the formation of manganese phosphate and magnesium fluoride or magnesium chloride and optionally magnesium aluminate.

It has surprisingly been demonstrated that a protective coating that is especially resistant to corrosion and wear can be produced on magnesium or magnesium alloys by anodic oxidation when the foregoing conditions are observed. The atomic oxygen needed to oxidize the magnesium is provided in accordance with the invention by using borate or sulfate anions that form peroxides and, although they do decompose readily, easily reconstitute themselves, due to the high current density, in the pores of the resulting protective coating. Borate and sulfate anions have proven to be especially appropriate in that, as a result of the conversion, they arrive only to a limited extent at the cathode, where they become reduced.

It has also been discovered that the electrolyte must contain anions that form difficult-to-dissolve compounds in conjunction with the magnesium that is being oxidized. These anions in accordance with the invention consist of phosphate ions combined with fluoride or chloride ions. When an alloy of magnesium and aluminum is to be anodically oxidized in accordance with the invention, aluminate ions come into existence from the aluminum that is present and join with the magnesium ions to form a difficult-to-dissolve magnesium aluminate.

The resulting protective coating must also contain pores or conductive sites to ensure a sufficient flow of current. This is attained in accordance with the invention by the fluoride or chloride ions added to the electrolyte.

It has also been demonstrated that it is important to maintain the correct ratio of anions to cations in the vicinity of the magnesium surface that is being coated because that is the only way to obtain a sufficiently stable and dense protective coating. Maintaining a constant direct current would lead to enrichment of the anions in the vicinity of the anode. The anions that would be particularly enriched are $OH^-$ ions, which are especially mobile, which would lead to the formation of a coating of $Mg(OH)_2$ on the surface of the magnesium. A coating of $Mg(OH)_2$, however, would be undesirable because of its low stability. Furthermore, an increase in the concentration of $OH^-$ ions would undesirably promote the formation of molecular $O_2$. The bath in accordance with the invention is accordingly adjusted to pH of 5 to 12 and preferably 8 to 9, especially by adding buffers.

It is possible to obtain in the vicinity of the surface being coated the desired concentration of anions that are to be inserted into the protective coating by employing a direct current that is briefly turned off or has its polarity incompletely reversed instead of a continuous direct current in order to allow the formation of manganese phosphate and magnesium fluoride or magnesium chloride and, when a magnesium alloy that contains aluminum is being oxidized, the formation of magnesium aluminate.

It is preferable to employ a continuous direct current with an alternating current superposed over it at a frequency of 10 to 100 Hz. The alternating current can be superposed by connecting a source of direct current to a source of sine current in series such that the alternating current is 15 to 30% of the direct current. An alternating current with an adjustable frequency to superpose over the direct current can be generated with frequency converters. Frequency converters are for example motor-generator units with speeds that can be varied to obtain a proportional change in frequency. The alternating current in this case is adjusted with a variable transformer to the desired percentage of direct current. The line frequency, 50 Hz in the Federal Republic of Germany and 60 Hz in the U.S. for example, is preferably employed.

To decrease the expense of obtaining an appropriate current contour, however, the anodic oxidation in accordance with the invention can also be carried out with a rectified alternating current at a frequency of 50 or 60 and with a ripple of 15 to 35%. The current can be rectified with an M1 one-way circuit or preferably with an M2 midpoint circuit (in accordance with DIN Draft 41 761). The resulting current can be smoothed with matching inductances that reduce the ripple to 15 to 35% (cf. e.g. R. Jager, Leistungselektronik Grundlagen und Anwendungen, Berlin, 1977, p. 75).

As an alternative, it is also possible to work with a direct current that is pulsed at 30 to 70 Hz, with the cutout time between two voltage pulses lasting between as long as and twice as long as the voltage pulse. The direct current can be pulsed with either electronic or mechanical switches activated by a frequency generator. Appropriate electronic switches for example are switching thyristors. A similar current contour can also be obtained by M1 half-wave rectifying an alternating current of 30 to 70 Hz and trimming the phase (in accordance with DIN Draft 41 761). The phase-trimming angle can be varied to control the length of the voltage pulse (cf. e.g. O. Limann, Elektronik ohne Ballast, Munich, 1973, p. 347).

Especially appropriate for buffering the electrolyte are amines that react weakly alkaline and generally have dissociation constants of $10^{-2}$ to $10^{-7}$. These amines are in particular such cyclic amines as pyridine, $\beta$-picoline, piperidine and piperazine. These amines generally dissolve readily in water. Other satisfactorily water-soluble amines that can be employed are for example sodium sulfanilate, dimethylamine, ethylamine, diethylamine and hexamethylenetetramine. Methenamine is especially preferred.

It is preferable to work with a voltage that increases to 400 volts. The current density is in particular 1 to 2 $A/dm^2$.

A low-alkali aqueous electrolyte in accordance with the invention is to be understood as one that preferably contains less than 100 mg/l of alkali ions. The ions that are to be avoided are those of the alkali metals lithium, sodium, potassium, etc. The ammonium ion is not considered an alkali ion in the present context.

The content of borate and sulfate ions in the aqueous electrolyte is preferably 10 to 80 g/l. The content of phosphate ions, in terms of $H_3PO_4$ is preferably 10 to 70 g/l. The amount of fluoride or chloride ions to be employed in conjunction with the phosphate ions is 5 to 35 g/l in terms of HF or HCl.

Before being subjected to anodic oxidation subject to the conditions in accordance with the invention, the pieces of magnesium or magnesium alloy are subjected to the conventional preliminary chemical degreasing treatments, especially alkaline cleaning in a powerful alkaline bath.

Degreasing is followed by conventional acid etching, for example with dilute aqueous solutions of phosphoric acid and sulfuric acid, and if necessary by activation with hydrofluoric acid.

The protective coatings produced on the surface of the magnesium or magnesium alloy in accordance with the invention are preferably also lacquered or subjected to further processing.

The protective coatings produced in accordance with the invention constitute a very satisfactory adhesive base for lacquers of the kind conventionally employed for pieces of magnesium, aluminum or zinc. These materials are two-constituent lacquers based on polyurethane and acrylic-resin, epoxide-resin, and phenolic-resin lacquers, etc.

Among the many materials tested were the commercially available products

1. Aqualac 8,
2. VP 5140 methacrylate (Degussa),
3. VKS 20 (phenolic resin),
4. Araldit 985 E,
5. water glass+$CO_2$, and
6. a dispersion of PTFE. Products 3, 4, 5, and 6 resulted in a definitely perceptible increase in the coatings' resistance to corrosion. The coating treated in Product 6 also resulted in a considerable decrease in the coefficient of friction.

To improve the tribological properties (slipperiness and dry-lubricant properties) of a surface coated in this way, it can then be subjected to further treatment with a solid lubricant, which can anchor in the available pores. Among the appropriate lubricants are fluorinated and/or chlorinated aliphatic and aromatic hydrocarbon compounds and molybdenum disulfide and graphite.

The protective coatings in accordance with the invention can also be subsequently treated with the aqueous solution of an alkali silicate. The result of this treatment is reaction of the $MgOH_2$ in the protective coating, especially in the pores, with the alkali silicate into difficult-to-dissolve magnesium silicate and alkali hydroxide. Once the piece with the protective coating has been removed from the alkali-silicate bath, it is preferably exposed in a second stage to an atmosphere rich in carbon dioxide. At this stage the "water glass" left over from the silicate treatment will in conjunction with the $CO_2$ from the atmosphere form $SiO_2$ and alkali carbonate as the more powerful carbonic acid expels the weaker silicic acid out of its compound. The $SiO_2$ will seal the pores in the protective coating, a process accelerated by contact with the $CO_2$. Since $SiO_2$ will rapidly precipitate from the outer vicinity of the pores when more powerful acids are employed, the alkali silicate inside the pores will no longer be able to react. The thoroughgoing precipitation of $SiO_2$ in the pores occasioned by the weak carbonic acid on the other hand will result in considerably more effective protection against corrosion.

The present invention also concerns magnesium alloys coated with a protective coating containing magnesium phosphate and magnesium fluoride that is 15 to 30 $\mu$m thick and will resist wear with a loss of mass measuring less than 20 mg following 10,000 revolutions in a Taber abrader (CS 10, 10 N).

A protective coating that satisfies the foregoing conditions can be applied by the method in accordance with the invention previously described herein for example.

The corrosion resistance of the magnesium alloys in accordance with the invention is, once the protective coating has been applied, preferably less than 10 corrosion points/$dm^2$ when a sample of the alloy is exposed for 240 hours in the salt-spray test in accordance with DIN 50021 SS.

Materials that are appropriate for producing a protective coating that is resistant to corrosion and wear by the method in accordance with the invention are, in addition to pure magnesium, those designated by the ASTM as AS 41, AM 60, AZ 61, AZ 63, AZ 81, AZ 91, AZ 92, HK 31, QE 22, ZE 41, ZH 62, ZK 51, ZK 61, EZ 33, and HZ 32 and the forging alloys AZ 31, AZ 61, AZ 80, M 1, ZK 60, and ZK 40.

The protective coating employed with the magnesium alloys in accordance with the invention preferably also contains hydroxide, borate, aluminate, phenolate or silicate ions. The pores of the protective coating in particular preferably contain silicon dioxide, which can be obtained by subsequently treating the protective coating with an aqueous solution of an alkali silicate as previously described herein. The protective coating applied to the magnesium alloys in accordance with the invention is white to whitish gray or tan.

The method in accordance with the invention will now be explained in greater detail with reference to examples.

EXAMPLE 1

The surfaces of the magnesium or magnesium alloys were initially treated in an alkaline cleaning bath composed of

| | |
|---|---|
| sodium hydroxide | 50 g/l |
| trisodium phosphate | 10 g/l |
| wetting agent - synthetic soap | 1 g/l |

The treatment in the alkaline cleaning bath was followed by etching in a bath composed of

| | |
|---|---|
| phosphoric acid (85%) | 380 ml/l |
| sulfuric acid (98%) | 16 ml/l |
| water | 604 ml/l |

The etching occured at a temperature of 20° C. and lasted approximately 30 seconds. The etching was followed by activating the surface of the sample in hydrofluoric acid.

This was followed by anodic oxidation to produce the protective coating in accordance with the invention, employing an electrolyte bath composed of

| | |
|---|---|
| HF | 30 g/l |
| $H_3PO_4$ | 60 g/l |
| $H_3BO_3$ | 70 g/l |

adjusted to a pH of 8.9 (with ammonia).

The anodic oxidation was carried out with a direct current of a density of 1.4 A/dm$^2$ with 20–35% of an alternating current of 50 Hz superposed over it. The voltage was increased up to 240 V. The oxidation lasted approximately 15 minutes. The protective coating produced on the surface being treated was approximately 20 μm thick.

EXAMPLE 2

A preliminary treatment such as that described in Example 1 was followed by anodizing an AZ 91 magnesium alloy in an electrolyte composed of

| | |
|---|---|
| hydrofluoric acid ($H_2F_2$, 40%) | 28 g/l |
| phosphoric acid ($H_3PO_4$, 98%) | 58 g/l |
| boric acid ($H_3BO_3$) | 35 g/l |
| hexamethylenetetramine | 360 g/l |

adjusted to a pH of 7.0 to 7.3 with $NH_4OH$ (25%). The current density was 1.4 A/dm$^2$ (a rectified alternating current with a ripple of approximately 28%). The final voltage was 325 V. The electrolyte temperature was 15° C. The exposure time was 15 minutes. The resulting coating was 21 μm thick.

Subsequent to anodization, the coating was treated for 15 minutes at a temperature of 95° C. with an aqueous solution of an alkali silicate (50 g/l), removed therefrom, and exposed to an atmosphere rich in carbon dioxide for 30 minutes.

This coating exhibited 2 corrosion points/dm$^2$ after a 500-hour corrosion test in accordance with DIN 50 021 SS.

The wear resistance was a loss of 30 mg of mass upon $10^4$ revolutions in a Taber abraser.

EXAMPLE 3

After the preliminary treatment described in Example 1, an Mg Al 6 Zn alloy was anodized in an electrolyte composed of

| | |
|---|---|
| hydrofluoric acid ($H_2F_2$, 40%) | 30 g/l |
| phosphoric acid ($H_3PO_4$, 98%) | 60 g/l |
| boric acid ($H_3BO_4$) | 70 g/l |
| dimethylamine (40%) | 260 g/l |

The bath was adjusted to a pH of 8.4 with $NH_4OH$ (25%). The current was a pulsed 40 Hz direct current turned on and off at a ratio of 1:2. The current density was 1.4 A/dm$^2$. The temperature of the electrolyte was 15° C. The final voltage was 320 V and briefly 400 V at the end of the treatment. Subsequent treatment was the same as described in Example 2.

The resistances to corrosion and wear were similar to those of the coating described in Example 2.

It is understood that the specification and examples are illustrative but not limitative of the present invention and that other embodiments within the spirit and scope of the invention will suggest themselves to those skilled in the art.

I claim:

1. A method of producing a protective coating that is resistant to corrosion and wear on magnesium or a magnesium alloy by anodic oxidation, comprising immersing the magnesium or magnesium alloy in a low-alkali aqueous electrolyte bath containing (a) borate or sulfate anions and (b) phosphate and fluoride or chloride ions and buffered with ammonia or an amine to a pH of about 5 to 11, applying a direct current to the bath, and pulsing the direct current, whereby on the surface of the magnesium or its alloy there is formed magnesium ammonium phosphate and magnesium fluoride or magnesium chloride.

2. The method according to claim 1, wherein the pulsing direct current is a continuous direct current with an alternating current superposed over it at a frequency of about 10 to 100 Hz and a current density of about 15 to 35% of the direct current.

3. The method according to claim 1, wherein the pulsing direct current is a rectified alternating current with a ripple of about 15 to 35%.

4. The method according to claim 1, wherein a direct current is pulsed at about 30 to 70 Hz, with the cut-out time between two voltage pulses lasting between as long as and twice as long as the voltage pulse.

5. The method according to claims 1, wherein the bath is buffered with an amine.

6. The method according to claim 1, wherein the bath is buffered with hexamethylenetetramine.

7. The method according to claim 1, wherein the current density is about 1 to 2 $A/dm^2$.

8. The method according to claim 1, wherein the voltage pulses to 400 V.

9. The method according to claim 1, wherein the bath contains less than about 100 mg/l of alkali ions.

10. The method according to claim 1, including the further step of treating the coating with an aqueous solution of an alkali silicate.

11. The method according to claim 10, including the further step of exposing the material, following alkali treatment, to an atmosphere rich in carbon dioxide.

12. The method according to claim 1, including the further step of lacquering the protective coating.

13. The method according to claim 1, wherein the material treated is an aluminum-containing magnesium alloy, and on its surface the material formed includes magnesium aluminate.

14. A magnesium alloy coated with a protective coating containing magnesium phosphate and magnesium fluoride that is 15 to 30 $\mu m$ thick and resists wear with a loss of mass measuring less than about 20 mg following 10,000 revolutions in a Taber abraser (CS 10, 10 N).

15. A magnesium alloy according to claim 14, having corrosion resistance of less than about 10 corrosion points/$dm^2$ subsequent to exposure to a salt-spray test for 240 hours in accordance with DIN 50 021 SS.

16. A magnesium alloy according to claim 14, wherein the protective coating also contains magnesium hydroxide, borate, aluminate, phenolate or silicate.

17. A magnesium alloy according to claim 14, wherein the protective coating contains silicon dioxide.

18. A magnesium alloy according to claim 14, wherein the protective coating is white to whitish gray or tan.

19. The method according to claim 1, wherein the bath contains (a) sulfate anions and (b) chloride ions.

* * * * *